United States Patent [19]

Newman

[11] 4,282,566

[45] Aug. 4, 1981

[54] SHOCK MOUNTING BRACKET FOR LAMP BULB

[75] Inventor: Charles J. Newman, Madison, Ind.

[73] Assignee: The Grote Manufacturing Company, Inc., Madison, Ind.

[21] Appl. No.: 30,001

[22] Filed: Apr. 16, 1979

[51] Int. Cl.[3] ..... F21V 21/00

[52] U.S. Cl. ..... 362/369; 362/296; 362/390; 362/226; 248/605; 248/618

[58] Field of Search ..... 362/72–73, 362/77–79, 80–83, 274, 288, 296, 306, 365, 368, 369, 372, 390, 226; 248/314, 205 R, 605, 618

[56] References Cited

U.S. PATENT DOCUMENTS

| | | | |
|---|---|---|---|
| 991,185 | 5/1911 | Weeks | 362/368 |
| 2,706,611 | 4/1955 | Kimball | 248/314 X |
| 3,300,636 | 1/1967 | Quelland | 362/372 |
| 3,327,110 | 6/1967 | Baldwin | 362/296 |
| 3,488,626 | 1/1970 | Koerper | 362/365 |
| 3,666,940 | 5/1972 | Magi | 362/410 |
| 4,163,276 | 7/1979 | Tabatchnik-Michaeli | 362/368 |

OTHER PUBLICATIONS

A Guide to Ultrasonic Plastics Assembly, Branson Instruments, Inc., 1973, pp. 42–43, 52–57.

*Primary Examiner*—Stephen C. Bentley

*Assistant Examiner*—Edward F. Miles

*Attorney, Agent, or Firm*—Harry B. O'Donnell, III

[57] ABSTRACT

This invention provides a novel bracket for shock mounting a bulb within a housing for a lamp that is particularly intended for use with motorized vehicles, such as over-the-road trucks and the like. Basically, the novel bracket of the present invention comprises: a serpentine strip having polygonal apertures provided at its opposite ends and a bulb-receiving socket generally centrally located therein, the radial center of which socket is offset from the long central axis that extends between the apertures in the strip. Preferably, the strip is connected to the lamp housing by fastener means, portions of which are respectively passed through the polygonal apertures in the strip and prohibit pivotal movement of the apertures thereabout. It is also desirable that the fastener means portions comprise a pair of studs projecting from the lamp housing and being complementary in size and shape to the polygonal apertures in the strip through which they are respectively passed. And, those apertures are preferably square in shape. It is further desirable that the strip be constructed of glass fiber-reinforced nylon or some other similarly suitable material permitting deflection of the strip along, around and across the long central axis thereof which extends between the polygonal apertures in the opposite ends thereof.

10 Claims, 4 Drawing Figures

2
13A
10
13B
13B
13c
3
3
12
11
13s
13s
13B
13A
13
13c
12
11
13B 13
14A
2
13s
15
13
13s
14A
11

13c
13s
13s
13
11
15
13A

SHOCK MOUNTING BRACKET FOR LAMP BULB

BACKGROUND OF THE INVENTION

This invention relates to lamps and, more particularly, to a novel and useful bracket for shock mounting an incandescent bulb within a housing for a lamp that is particularly intended for use with motorized vehicles such as over-the-road trucks and the like.

Many different types of lamps are used on motor vehicles and are, as a result, subject to frequent vibrations and mechanical shocks. Unless the incandescent bulbs of such lamps are protected from such vibrations and shocks, they may fail quite rapidly.

In the past, several forms of prior-art means have been provided for "shock mounting" a bulb within a housing for lamps that are to be employed on motor vehicles. Typical forms of such prior-art mountings are shown and described in detail in U.S. Pat. Nos. 3,300,636 (Quelland et al); 3,327,110 (Baldwin) and 3,666,940 (Magi).

All three of the aforenoted forms of prior-art shock resistant bulb mountings attempt to cushion the bulbs by damping out the vibrations before they are imparted to the bulbs. However, as particularly pointed out in the Magi patent, one must carefully balance the degree of movement of the bulb that is permitted by the mounting for the purpose of shock and vibration damping against possible excessive displacement of the bulb from its desired proper location with respect to the lamp lens. And, in an effort to control this problem of excessive bulb displacement, Magi integrally forms his bulb socket shock mounting strip with his lamp housing, rather than employing for the bulb socket shock mounting either the hooked springs of Quelland et al or the strip of Baldwin that is pivotally connected to the lamp housing by a pair of round apertures located at its opposite ends which are respectively slipped over a pair of cylindrical pillars that project from the lamp housing.

While the aforenoted Magi form of bulb shock mounting may offer the advantages claimed by its patentee over those older prior-art forms shown by Quelland et al and Baldwin, Magi's requirement that his bulb shock mounting be integrally formed with his lamp housing presents certain other readily apparent disadvantages.

The present invention is, among other things, concerned with providing a novel bulb shock mounting which overcomes the aforenoted problems of the older prior-art forms of Quelland et al and Baldwin, while also avoiding the aforenoted disadvantages of the newer prior-art form of Magi.

It is yet another purpose of the present invention to provide a novel bulb shock mounting that is still further structurally distinguished over the aforenoted prior-art forms of mountings in that the radial center of its bulb receiving socket is offset from the long central axis of the shock absorbing means which interconnect that socket to the lamp housing.

SUMMARY OF THE INVENTION

The present invention provides a novel bracket for shock mounting an incandescent bulb within a housing for a lamp that is particularly intended for use with motorized vehicles, such as over-the-road trucks and the like.

Basically, the novel bracket of the present invention comprises: a serpentine strip having polygonal apertures provided at its opposite ends and a bulb-receiving socket generally centrally located therein, the radial center of which socket is offset from the long central axis that extends between the apertures in the strip. Preferably, the strip is connected to the lamp housing by fastener means, portions of which are respectively passed through the polygonal apertures in the strip and prohibit pivotal movement of the apertures thereabout.

It is also desirable that the fastener means comprise a pair of studs projecting from the lamp housing and being complementary in size and shape to the polygonal apertures in the strip through which they are respectively passed. And, those apertures are preferably square in shape.

It is further desirable that the strip be constructed of glass fiber-reinforced nylon or some other similarily suitable material permitting deflection of the strip along, around and across the long central axis thereof which extends between the polygonal apertures in the opposite ends thereof.

BRIEF DESCRIPTION OF THE DRAWING

The present invention is illustrated in the accompanying drawing, wherein.

DETAILED DESCRIPTION

Figures 1, 2, 3, 4:
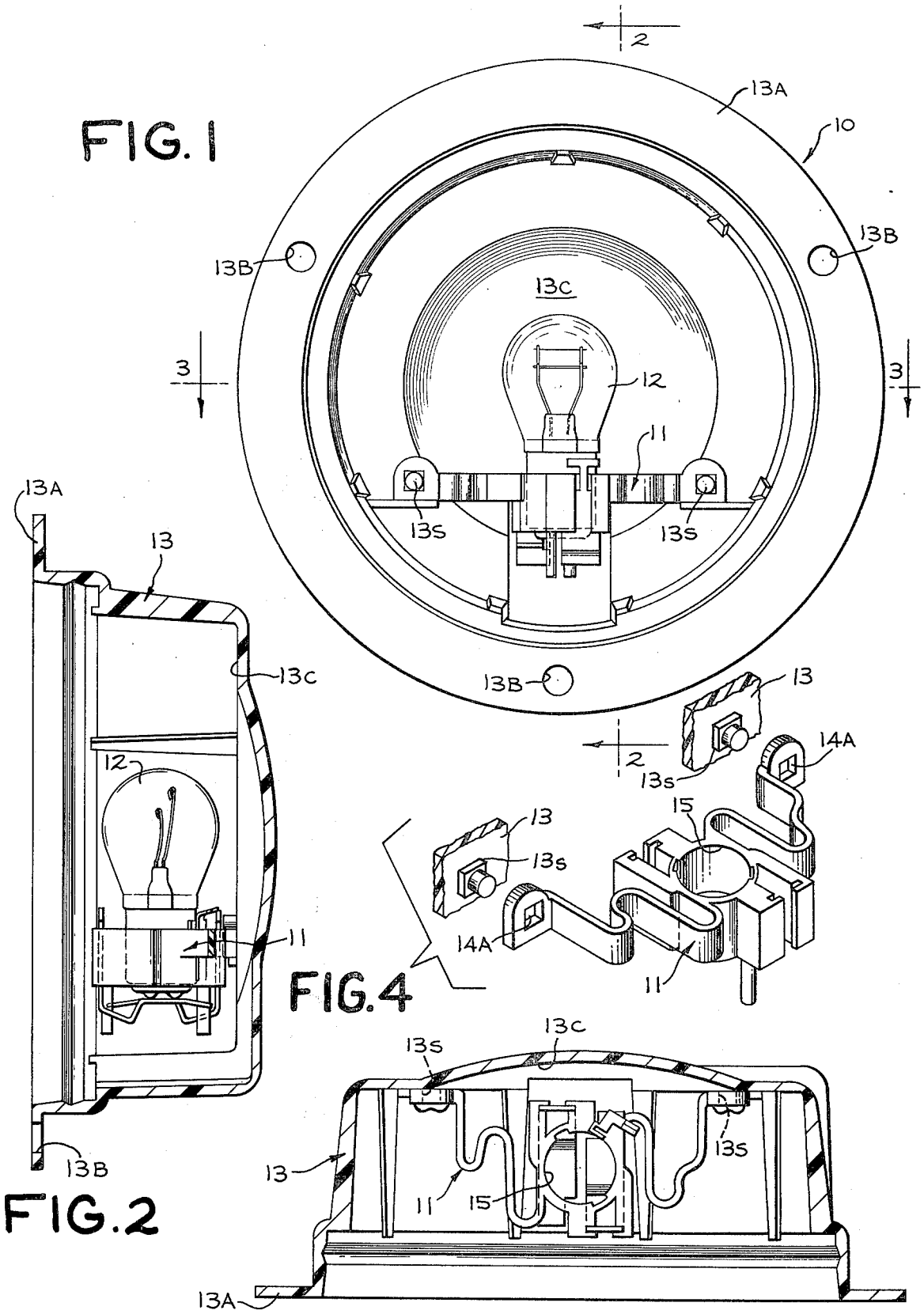
FIG. 1 is a somewhat schematic front elevational view of the lamp employing a presently preferred form of the novel bulb mounting bracket that is provided in accordance with the present invention, with the lens cover removed, and prior to the heat-staking of the lamp housing studs.
FIG. 2 is a sectional view taken along Line 2—2 of FIG. 1.
FIG. 3 is a sectional view taken along Line 3—3 of FIG. 1, with the bulb removed and after the heat-staking of the lamp housing studs.
FIG. 4 is a partly-broken exploded perspective view illustrating the form of the novel bulb-mounting bracket shown in FIGS. 1–3, as it appears prior to its connection the lamp housing.

Turning now to the drawing and, more particularly, to FIGS. 1–4 thereof, there is illustrated a lamp 10 that is particularly intended for use with motor vehicles, such as over-the-road trucks and the like (not shown), employing a presently preferred form of a novel bracket 11 that is provided in accordance with the present invention for shock mounting an incandescent bulb 12 within the lamp housing 13.

With the exception of the unique construction of the means for fastening the novel bulb-mounting bracket 11 of the present invention thereto, which will be discussed in detail hereinafter, the lamp housing 13 is otherwise generally conventional and comprises a cup-shaped member having a flanged rim 13A that is provided with a plurality of apertures 13B through which are passed screws or other suitable fastening means (not shown) for attaching the same to the motor vehicle (also not shown).

In accordance with a particular advantageous aspect of the present invention, the lamp housing 13 need not be integrally formed with the bulb-mounting bracket 11 and, hence, may be made of a different material of construction than the bracket 11. While various materials of construction may be employed for the lamp housing 13, good results have been obtained in molding the same of a polycarbonate, such as that sold by Mobay Chemical Company under the trade name of "Merlon", or polypropylene, such as that sold by Exxon Chemical Company as its "Number 805-HC".

In any event, the concave surface 13C of the lamp housing 13 is, of course, coated with a luminous finish, in a well-known manner, to provide a reflective background for the light which is emitted from the incandescent bulb 12 when mounted therein by the novel bracket 11 of the present invention.

As particularly illustrated in drawing FIG. 4, the novel bulb-mounting bracket 11 of the present invention basically comprises: a serpentine strip having polygonal apertures 14A provided at its opposite ends and a bulb-receiving socket 15 integrally formed therein and generally centrally located therein with respect to those two apertures 14A but with the radial center of the socket 15 being offset from the long central axis that extends between the two apertures 14A in the bulb-mounting strip 11.

As further shown in drawing FIGS. 1 and 3–4, the novel bulb-mounting bracket strip 11 of the present invention is preferably connected to the lamp housing 13 by unique fastener means, portions 13S of which are respectively passed through the polygonal apertures 14A in the bulb-mounting bracket strip 11 and prohibit pivotal movement of those apertures 14A thereabout. As illustrated in the drawing Figures, is is desirable that these fastener means portions 13S comprise a pair of studs integrally formed with and projecting from the concave surface 13C of the lamp housing 13 which include portions immediately adjacent to the lamp housing 13 that are complementary cross-sectional in size and shape to the polygonal apertures 14A in the bulb-mounting bracket strip 11 through which they are respectively passed. And, those mounting bracket strip apertures 14A are preferably square in shape, as best shown in drawing FIGS. 1 and 4.

It is most desirable that the novel bulb-mounting bracket strip 11 of the present invention be constructed of a glass fiber-reinforced nylon, or some other similarly suitable material permitting deflection of the serpentine strip 11 along, around and across the long central axis thereof which extends between the polygonal apertures 14A in the opposite ends thereof. While various materials of construction may be employed for this purpose, good results have been obtained in molding the same of DuPont's "Zytel" Nylon #71G-33, Grade #66. It has also been found to be particularly advantageous to boil the thus constructed mounting bracket 11 in water for eight hours following its molding and prior to its fastening within the lamp housing 13.

After the polygonal apertures 14A at its opposite ends have been respectively slipped over the complementary polygonal portions 13S of the studs of the lamp housing 13 to, thus, prohibit pivotal movement of those apertures 14A about those stud portions with respect to the lamp housing 13, the novel bulb-mounting bracket strip 11 of the present invention is, then, secured against movement along the long axes of those studs, preferably by "heat-staking" the cross-sectionally round distal ends thereof as particularly shown in drawing FIG. 3.

Thus, the foregoing arrangement provides a solidly mounted non-symmetrical suspension system for the incandescent bulb 12 that is constructed to provide an elliptical movement to the bulb 12 when the lamp housing 13 is subjected to any horizontal or vertical force or combination thereof, as imparted to it from shocks or vibrations sustained by the vehicle on which the lamp 10 is mounted. Such forces cause the serpentine strip that comprises the novel bulb-mounting bracket 11 of the present invention to twist or deflect along, around and across the long central axis which extends between the polygonal apertures 14A in its opposite ends and thereby dampen the transmission of those forces to the bulb 12 while prohibiting any pivotal movement of those apertures 14A about the housing studs 13S that are respectively passed therethrough and, consequently, without causing undesirably excessive displacement of the bulb 12 from its desired proper location with respect to the lamp housing 13.

It should be apparent that while there has been described what is presently considered to be a presently preferred form of the present invention in accordance with the Patent Statutes, changes may be made in the disclosed device without departing from the true spirit and scope of this invention. It is, therefore, intended that the appended claims shall cover such modifications and applications that may not depart from the true spirit and scope of the present invention.

What is claimed is:

1. A novel bracket for shock mounting a bulb within a housing for a lamp, comprising:

a serpentine strip means for mounting said strip within the housing, said means for mounting comprising polygonal apertures provided at opposite ends of said strip and polygonal fastener means extending through said aperture, said fastener means having a cross-sectional size and shape complementary to said apertures, said fastener means and said apertures constituting means for preventing pivoting of said strip about said fastener means; and a bulb-receiving socket generally centrally located in said strip, with said socket having its radial center offset from a long central axis that extends between said apertures of said strip.

2. The invention of claim 1, wherein said fastener means comprise a pair of studs projecting from said housing.

3. The invention of claim 2, wherein said polygonal apertures in said strip are square in shape.

4. The invention of claim 3, wherein said strip is constructed of a material permitting deflection of said strip along, around and across said long central axis thereof which extends between said apertures.

5. The invention of claim 2, wherein said strip is constructed of a material permitting deflection of said strip along, around and across said long central axis thereof which extends between said polygonal apertures.

6. The invention of claim 1, wherein said strip is constructed of a material permitting deflection of said strip along, around and across said long central axis thereof which extends between said polygonal apertures.

7. The invention of claim 6, wherein said strip is made of glass fiber-reinforced nylon.

8. The invention of claim 7, wherein said strip is molded of DuPont's "Zytel" Nylon #71G-33, Grade #66.

9. The invention of claim 8, wherein said strip has been boiled in water for at least eight hours following its molding and prior to its fastening within said housing.

10. The invention of claim 1, wherein said polygonal apertures in said strip are square in shape.

* * * * *

UNITED STATES PATENT AND TRADEMARK OFFICE

CERTIFICATE OF CORRECTION

PATENT NO. : 4,282,566

DATED : August 4, 1981

INVENTOR(S) : Charles J. Newman

It is certified that error appears in the above—identified patent and that said Letters Patent is hereby corrected as shown below:

Column 3, line 32, after "complementary", "cross-sectional in" should read -- in cross-sectional --.

Column 4, line 25, after "a serpentine strip", a semi-colon -- ; -- should appear.

Signed and Sealed this

*Thirteenth* Day of *October 1981*

[SEAL]

*Attest:*

GERALD J. MOSSINGHOFF

*Attesting Officer*

*Commissioner of Patents and Trademarks*